US008479674B2

(12) United States Patent
Sporsheim

(10) Patent No.: US 8,479,674 B2
(45) Date of Patent: Jul. 9, 2013

(54) SYSTEM AND METHOD FOR THE ACTIVE AND PASSIVE STABILIZATION OF A VESSEL

(75) Inventor: Ove Sigbjorn Sporsheim, Molde (NO)

(73) Assignee: Marine Roll & Pitch Control AS, Molde (NO)

( * ) Notice: Subject to any disclaimer, the term of this patent is extended or adjusted under 35 U.S.C. 154(b) by 0 days.

(21) Appl. No.: 12/745,912

(22) PCT Filed: Dec. 5, 2008

(86) PCT No.: PCT/NO2008/000435
§ 371 (c)(1),
(2), (4) Date: Jun. 10, 2010

(87) PCT Pub. No.: WO2009/072901
PCT Pub. Date: Jun. 11, 2009

(65) Prior Publication Data

US 2010/0275829 A1 Nov. 4, 2010

(30) Foreign Application Priority Data

Dec. 7, 2007 (NO) ..... 20076308

(51) Int. Cl.
*B63B 43/06* (2006.01)

(52) U.S. Cl.
USPC ..... 114/121; 114/125

(58) Field of Classification Search
USPC ..... 114/122, 125, 121
See application file for complete search history.

(56) References Cited

U.S. PATENT DOCUMENTS

| | | | | |
|---|---|---|---|---|
| 968,927 | A | 8/1910 | Frahm | |
| 2,889,795 | A * | 6/1959 | Parks | 114/122 |
| 3,349,740 | A | 10/1967 | Field | |
| 3,537,412 | A * | 11/1970 | Henderson | 114/122 |
| 4,167,147 | A * | 9/1979 | Bergman | 114/122 |
| 4,231,313 | A | 11/1980 | Heerma et al. | |
| 5,375,550 | A * | 12/1994 | Innis | 114/267 |

FOREIGN PATENT DOCUMENTS

| | | |
|---|---|---|
| GB | 2091192 | 7/1982 |
| GB | 2343434 | 5/2000 |

* cited by examiner

*Primary Examiner* — Stephen Avila
(74) *Attorney, Agent, or Firm* — Ladas & Parry, LLP

(57) ABSTRACT

System for the active and passive stabilization of a vessel (10), such as ships, boats, rigs, barges, platforms and cranes operating in a maritime environment, which vessel (10) is provided with tanks (Ha-d) to provide buoyancy and/or ballast, which tanks (11*a-d*) are provided with openings (12*a-d*) in the bottom, which openings (12*a-d*) are facing the medium in which the vessel (10) is floating. The tanks (11*a-d*) are independent of each other and the openings (12*a-d*) are so large that a sufficient volume of fluid can pass without cavitation or other resistance, and the system includes means (13*a-d*) for supplying fluid to the tanks (11*a-d*), controlled to counteract the effects of external forces on the movements of the vessel (11). The invention further includes methods for the passive and active stabilization of the vessel by use of the system.

26 Claims, 6 Drawing Sheets

SYSTEM AND METHOD FOR THE ACTIVE AND PASSIVE STABILIZATION OF A VESSEL

BACKGROUND OF THE INVENTION

The invention relates to a system for active and passive stabilization of a vessel. The invention also relates to a method for active and passive stabilization of a vessel by use of the system.

DESCRIPTION OF RELATED ART

Today, most vessels are not provided with active stabilization, although for vessels working together with fixed installations this is desired, and this has until now been considered as a natural thing and taken as a matter of course. Where vessels do not have this feature, they must, in bad weather and unfavourable wave conditions, space themselves at a distance, waiting for weather changes. Even when weather conditions are relatively good and the motions of the vessel are small, they are very vulnerable in relation to the wave movements and completely at their mercy. Not only vessels, as ships or boats, but also rigs, platforms, cranes etc., will benefit greatly from active stabilization. A vessel without a suitable system for active stabilization may be compared to a car without shock absorbers, which would be unthinkable in terms of road safety.

Seagoing vessels are, as is known, affected by the movement of waves and other static loads.

From prior patent literature, among other things, the use of tanks which are open in the bottom, is known especially on oil rigs. These tanks function by having an adjustable valve at their top part, which leads into the atmosphere. Because of the static movement that the rig experiences in high seas, the ratio of filling of sea water in the tanks can be adjusted to compensate and reduce the movement.

Other systems which presently used to avoid roll are stabilization tanks and Anti Heeling pumps, although in these cases a large proportion of the loadbearing capacity of the vessel can not be used. The vessel is in addition exposed to constant loading without any possibility of controlling changes, for example, in the draught. The Anti Heeling pump is an active pump system, but it often has insufficient capacity in relation to what is desired.

In prior art systems such as this, it is a huge problem that, as fluid is pumped from one full tank to another, making effectively two tanks which are each half full with ballast with a free fluid surface. In terms of stability, this is a dangerous situation. Another problem with the prior art systems is that only one valve is used to close the flow of fluid between the tanks, which results in an unstable system, especially if the valve is locked in the open position, in which case the fluid in these two tanks can flow freely between the two tanks, from starboard to port.

From GB 2 091 192A a vessel is known, which is provided with tanks for stabilization. These tanks have openings in the bottom and are used for active and passive stabilization. A major disadvantage of GB 2 091 192 A is that only compressed air and storage tanks are used for active and passive stabilization, with low pressure (¼ to ¾ bar) and high pressure (3 to 7 bar), which means that all changes of the level in the ballast tanks must take place below the water level, and only the buoyancy in the ballast tanks can be changed. This also means that a limited ballast volume is available.

Vessels performing anchoring operations are often provided with bulky machinery and have a high consumption of diesel fuel so that, a planned operation may take much longer time than expected and will result in reduced stability as the diesel tanks are gradually emptied.

Present vessels with stabilization tanks are vulnerable if a critical situation arises, for example, a power failure or similar, in which case the vessel may not be able to transfer ballast.

Where vessels are required to carry out towing operations, this is done by changing direction by rudder deflection, with the result that the load can be moved very quickly from starboard to port and with the present systems it is not possible for the stabilization to be transferred rapidly enough.

In connection with towing operations, a long tow rope with weights is used between the towing vessel and the object being towed. This is to reduce the variations in the tension of the tow rope due to constant changes in the wave resistance. After each wave the vessel must accelerate to recover the velocity the vessel had before it hit the wave. The more this wave resistance can be reduced, the more economical it will be for the planned operation.

It is generally very desirable for the influence on the environment from vessels to be reduced, both in relation to economics, but also in relation to NOx emissions. This will result in a better environment and less pollution—an important topic in the community today.

The lack of active stability in relation to movement also affects all vessels where a certain amount of manual work has to be carried out by people. A fishing boat is an example of a kind of vessel where the considerable damage can be caused as a result of the many manual tasks performed during catching and processing of fish. The speed of stabilization may differ between an accident and a normal operation. A system which can more rapidly stabilize and compensate forces affecting the vessel is highly desired.

Many vessels are designed to pass through certain lock systems for waterways or shallow waters, and these vessels are designed to always have a low draught, something which may result in stability problems.

Icebreakers are another kind of vessel, which have a special hull design associated with the properties of breaking ice. These vessels must carry large amounts of ballast, which has to be transferred from the stern to the prow of the vessel and this can produce uncontrolled situations. The movement of ballast will always have an uncontrolled effect on all ships.

A number of vessels throughout the world lie on standby due to high seas in case their attendance is required. This can result in unnecessary pollution and unnecessary costs, as the vessels must lie idle on standby. It is thus very desirable that a vessel should be able to operate during worse conditions than is the case for present vessels, while at the same time ensuring the safety of vessels and crews.

Also for vessels having a helicopter deck, there will be a need for improved stability and compensation for vertical movements, as the helicopter will not be able to land if the movements of the vessel are too great.

It is therefore obvious that there is a need for most vessels to have a more rapid and active stabilization of vessel than is the case today. There is also presently a lack of passive stabilization of vessels.

SUMMARY OF THE INVENTION

The main object of the invention is to provide a system and methods for the active and passive stabilization of a vessel, especially controlling the vertical movement of all floating vessels/barges and rigs/platforms caused by the effect of waves, displacements or movement of load/ballast and crane work.

It is further an object of the invention to reduce the maximum movement which affects vessels today, i.e. reducing pitch, roll and draught.

It is further an object of the invention that it should be possible to maintain the distance between the vessel and the sea bottom as constant as possible.

It is finally an object of the invention that the system and methods should improve or entirely eliminate the above mentioned disadvantages of prior art systems, and result in improved security for both crew and vessels operating in maritime environments, which are provided with the system and methods according to the invention.

All floating objects which are to be referred to, and which are to be controlled according to the invention, will hereinafter be referred to as vessels.

A system according to the invention mainly includes tanks, means for supplying and removing fluid to and from the tanks, and a control system for controlling the means for supplying and removing fluid to and from the tanks, based on information on the movements of the vessel and the effects of the environment on the vessel. A vessel to make use of the system and the methods according to the invention is advantageously provided/designed with adapted tanks on adapted locations, having an opening at the bottom, which is large enough for a sufficient volume of fluid to pass without cavitation or other resistance in the openings of the tanks.

The tanks preferably further are of a sufficient height in relation to the sea level, such that a sufficient volume of fluid can compensate the buoyancy which produces changes in pitch, roll and draught of the vessel. At the upper part of the tanks, there are arranged means for supplying and removing fluid to and from the tanks, for example, vacuum compressors or similar, which are used to control the pressure/vacuum over the fluid surface in the tanks, and in this way can raise the fluid level in the tanks to provide the desired ballast or lower the fluid level to provide buoyancy for the vessel at any time. The fluid volume in the tanks is controlled by the control system so that the fluid level is changed to compensate the forces affecting the vessel, such as the movement of the sea on the vessel or other components/loads affecting the vessel, which results in vertical movements.

In a traditional vessel, the roll, pitch and draught movements are usually compensated by means of the displacement of floating fluid in tanks, which fluid amounts are a part of the tonnage of the vessel. As described above, this is "closed" systems which may result in stability problems, especially in cases of failure, as these systems will not provide sufficient ballast/buoyancy within an acceptable time, due to limitations in the available total fluid volume and capacity of pumps. In addition they reduce the total load capacity of the vessel, as the fluid volume is a part of the tonnage of the vessel.

By means of the invention, the tanks do not basically include any fluid amount, but will be provided with fluid through the operation of the system, and only as required. In this way, the vessel will have a maximum load capacity. Because the system utilizes the medium in which it floats to provide ballast for the vessel, this results in no limitations in relation to fluid volume, as long as the tanks are appropriate for the vessel and arranged at suitable locations of the vessel. As the tanks are open against the medium the vessel is floating in, the vessel will be able to utilize this entire medium as fluid supply.

The system according to the invention includes, as mentioned above, a control system for the control of ballast/buoyancy in the tanks. The control system will receive information from different sources on the status of the tanks at any time, and information on the movements of the vessel. Information on the movements of the vessel can, for example, in one embodiment, be provided by a MRU (Motion reference unit) and VRU (Vertical reference unit), which provide information on the vertical movements of the vessel or similar, i.e. with roll, pitch and draught references. Here it also will be advantageous with, for example, gyro stabilization. In the offshore industry, most vessels are provided with a DP system. DP—Dynamic Positioning—is basically a method for holding a ship and semi-submersible rigs in the same horizontal position above the sea bed maintaining the same direction or maintaining the same position in relation to another vessel or floating structure without the use of an anchor, by using the vessel's own propellers and thrusters. The DP system includes means for predicting changes before they actually happen, to compensate for changes in the environment around the vessel thereby ensuring a steady operation. If a vessel is provided with a DP system, the control system according to the invention can utilize the information from this on the movements of the vessel.

A method for active stabilization according to the invention can be summarized in the following steps:

1. Acquiring information on the movements of the vessel from a MRU and/or a VRU and/or a DP system or similar, which provides information on the movements of the vessel,
2. Acquiring information on the state in the tanks of the system,
3. Based on information from the steps 1 and 2, calculating the ratio of filling for the different tanks by means of a control system according to the invention, i.e. if vacuum and/or pressure is to be supplied, where pressure only is supplied if the level of the tank is to be lower than the fluid level in which the vessel is floating,
4. Providing means for controlling vacuum and/or pressure in the tanks with settings based on the calculation in step 3,
5. Supplying pressure and/or vacuum to the tanks by means of means for controlling the fluid volume in the tanks, until the means for the status of the tanks respond to the control system according to the invention that the desired pressure and/or vacuum is achieved,
6. Repeating the steps 1-5.

Steps 1 and/or 2 can in addition to acquiring information on the movements of the vessel also include acquiring information on wave height and frequency, which information is acquired by suitable means, such as wave calibration and/or pressure sensors and/or radar and/or laser or similar means, which means are preferably arranged along the sides of the vessel to provide information on wave height and frequency.

Wave calibration is based on level tubes, which preferably are arranged in the vertical direction along the vessel side. The reference point for the lower part of the level tubes is the horizontal trim of the vessel. By arranging a level sensor in each tube, the wave height at the reference point can be read out at each tube. To indicate a wave direction movement by this principle, a minimum of three sensors must be used. Provided that at least three sensor tubes are arranged in each wave frequency, it is possible to read out the wave direction. By calibrating and synchronising the levels of each individual sensor between the starboard and the port sides and the prow of the vessel, the actual direction of the waves affecting the vessel can be obtained at all times.

This principle can also be used to calculate the changing fluid volume/displacement which affects the movement of the hull in relation to the vertical movement of the vessel, such as: LCB—longitudinal centre of buoyancy, VCB—vertical centre of buoyancy and LCF—longitudinal centre of floatation.

The system can also act as a passive stabilization of a vessel provided with a system according to the invention. To perform passive stabilization, the means for supplying and removing fluid to and from the tanks include a controllable valve, arranged to each tank. As a vessel travels against the tide and a controlled airflow has been calculated at the top of the tanks, the tank(s) will be filled depending of the effects of the sea. As the vessel then has its maximum filling of the tank(s), it will have its maximum draught at that point. As the vessel starts to rise due to the shape of the hull and buoyancy the airflow to the tank(s) will close so that the vessel is weighted in such a manner that it is prevented from rising. However, this weighting should disperse by the time that the vessel reaches its uppermost position. This is achieved by opening the airflow to the tank(s) and the fluid disappears immediately.

If we then look at a tank in the prow of the vessel, the ratio of filling inside the prow should follow the level of the sea gets under the effects of the waves, and thus the buoyancy in the prow is reduced as the tank is filled with fluid. As the wave outside passes the rear end of the prow, the wave will affect the hull for increased buoyancy, but as the wave passes the prow, the fluid volume in the prow will reduce the wave buoyancy on the hull behind the prow. As the vessel starts to lose buoyancy due to the wave passing the prow of the vessel, it is desirable for the fluid volume in the tank in the prow to be reduced, as a result of which the vacuum in the tank in the prow is removed and the tank then disperse the fluid which was used as counterweight as the wave passed the prow. As the next wave hits the prow of the vessel, the tank in the prow is again ready to be filled with fluid, so that the ratio of filling starts to adapt to the actual wave height. One method for passive stabilization according to the invention can be summarized in the following steps:

1. Acquiring information on the movements of the vessel from a MRU and/or a VRU and/or a DP system or similar, which provide information on the movements of the vessel,
2. Acquiring information on the status of the tanks in the system,
3. Based on information from the steps 1 and 2, calculating if the tanks should have reduced or increased buoyancy,
4. Opening the valve at the desire of buoyancy and/or close the valve at the desire of increased buoyancy in the tanks.

Steps 1 and/or 2, in addition to acquiring information on the movements of the vessel, can preferably also include acquiring information on wave height and frequency, which information is acquired by means of suitable means, such as pressure sensors, radar and/or laser or similar means, as wave calibration, which means preferably are arranged along the sides of the vessel to provide information on wave height and frequency.

By means of the system and the methods according to the invention, the vessel can be provided with ballast and/or buoyancy according to what is desired in relation to the coming changes in the environment, either by passive or active stabilization of the vessel, or as a combination of active and passive stabilization of the vessel, and in this way compensate these changes, especially the vertical movements.

The system and methods according to the invention will be able to work under different conditions, for example:

1. Reduction of pitch during sailing, which provides a fuel reducing effect, security effect for vessel and persons and increased comfort for passengers and sailors,
2. Reduction of pitch and roll, which provides the same advantages as under point 1, and secure working onboard or in conjunction with another installation or vessel,
3. Reduction of pitch, roll and control of draught, which provides the same advantages as under point 1 and 2, and working with seabed installations,
4. Control of draught, which can be utilized during a difficult approach, or with submersible vessels performing operations such as transport, loading/unloading ships, which operate at quaysides, where low and high tide levels can complicate loading/unloading.

The system according to the invention will not have any of the above-mentioned problems encountered in the prior art systems, because the tanks can work independently of each other, which results in a stable system, with few possibilities for errors and dangerous situations, such as instability or lack of capacity to provide ballast due to the limited fluid volume. Stability can also be provided more rapidly compared with existing systems, as traditional pumps will not be able to provide the same capacity as the system according to the invention.

The system will further result in that vessels will be able to withstand adverse weather and wave conditions, as the vessel can compensate the effects of environmental changes, such as wave forces to a greater extent than earlier. The total volume intended for active stabilization can be used to increase the buoyancy of the vessel during extreme wave and/or load conditions. Even though the vessel lies normally low in the water in loaded conditions, this can be changed by using the buoyancy volume it has available by not using the tanks with fluid. This will result in reduced energy costs, as the vessel will be better able to withstand the effects of the waves and thus be able to maintain its position better than what is possible by only using propellers and thrusters. In this way, the vessel will be able to reduce energy consumption by a lesser use of thrusters and propellers.

Where a vessel is provided with a DP system, it receives signals from satellites regarding on its actual position through antennae high above the turning point of the vessel, and for the roll and pitch of the vessel, this position will change by several metres in relation to the vessel's actual position. If the vessel tilts over to the starboard side, the position of the vessel will show a number of metres to starboard, corresponding to the difference in length between the centre point of the vessel's turning point and vertically up to the receiver antenna. The propellers and/or thrusters will then try to prevent this change in position and displace the vessel by the corresponding distance in metres to the port side. If this movement occurs on a regular basis, the DP system can compensate for it through its "learning function". The DP system usually uses circa 20 minutes for each positioning to establish a pattern for changes in wind, waves, current, etc. If the vessel is provided with a system according to the invention, this margin of error can be reduced considerably. Another advantage with the invention, which does not receive much attention in the further description, is that the system according to the invention has the possibility of varying the DP learning pattern. In one situation active stabilization is used and the DP learning system thinks that the waves, current and wind are according to this, and in the next situation the system is turned off and the waves appear different against the vessel. The DP system will thus be able to more rapidly update changes by acquiring information from the different sensors in the system in the present invention, so that rapid changes in weather and/or operating conditions can be rapidly and precisely updated.

In addition to the above description, the present invention can serve to change the draught of the vessel instead of vessels having to operate on shallow water with always a too small draught.

NOx emissions can also be radically reduced with an active and passive stabilization according to the invention. Where a vessel is subject to movements, this is particularly affected by the diesel engines, where changes of the diesel output constantly change the handling of load, to which the vessel is exposed. The greater the changes in the resistance in this activity, the poorer the combustion obtained in a diesel engine. This can also be compared with the reduction of a maximum speed of, for example, 15 to 14 knots, making the final sailing distance covered at almost the same time, but at a significant economic gain.

The present invention also ensures increased stability in comparison to that of existing vessels.

From known accidents in shipping, it is known that the displacement of ballast has not been carried out due to, for example, power failure. If the vessels had been provided with a system according to the invention, nothing would have affected the vessel in a power failure situation, as the load in the stabilization tanks only would have flowed out. If the system in addition was provided with an emergency backup system, this could operate the valves to achieve stabilization even though a power failure occurs.

Also cruise ships will benefit greatly from the invention, as they can use the system to reduce pitch during sailing, which will result in lower fuel consumption and better comfort for passengers with regard to seasickness. This may also reduce the delay of the sailing and prevent parts of the route from being shortened.

If the system is used on icebreakers, which have a specially formed hull to break ice, which results in poorer sailing properties than for common ships, this will ensure that icebreaker vessels are provided with better stability conditions during sailing. Instead of having a large amount of ballast water for pumping ballast from the stern to the prow of a vessel, the vessel can have a normally designed stern, and take in sea water at the stern and the prow I by means of vacuum instead of pumps. Instead of transferring fluid from the stern to the prow of the vessel, the vessel will still have the total ballast weight, but by taking in and out weight directly from the sea, the weight will change rapidly. The vessel can be relatively light at climbing on the ice, and rapidly increase the weight if there are problems breaking the ice.

By means of the invention all vessels, where manual tasks are carried out, would be able to achieve better stability, which results in less vertical movement, which results in turn in better working conditions and thus also fewer accidents.

By means of the invention there will be less need for heave compensation of cranes and rigs, because the vessels will have less vertical movement than that achieved with prior art technology, something resulting in more rapid and precise operation at sea.

The above described examples show that the area of use is large and the possibilities for a system according to the invention are many. In the community today, where it is a huge focus on the environment, it will be appreciated that all vessels using the present invention will save fuel and thus have lower emissions.

It is obvious that all vessels must have the theoretical stability requirements that apply today, and that the present invention applies in addition to this.

It is further obvious that the system can be manual and/or automatic, and that there will be possibilities of setting the trim as desired. In some cases it will be sufficient for the vessel to have only filled stability tanks to increase the total weight of the vessel. If the vessel is not sailing, this can be sufficient for some tasks. Draught and weight of the vessel can be adjusted to the most profitable operating situation for each situation, and can rapidly be changed. In a sailing situation today, it often happens that the vessels take on extra ballast during bad sailing weather, but even if the weather improves, the sailing continues with the same ballast as during bad weather.

Further details will appear from the following description.

BRIEF DESCRIPTION OF THE DRAWINGS

The invention will in the following be described in detail with references to the drawings, where.

DESCRIPTION OF THE PREFERRED EMBODIMENTS

Figure 1A:
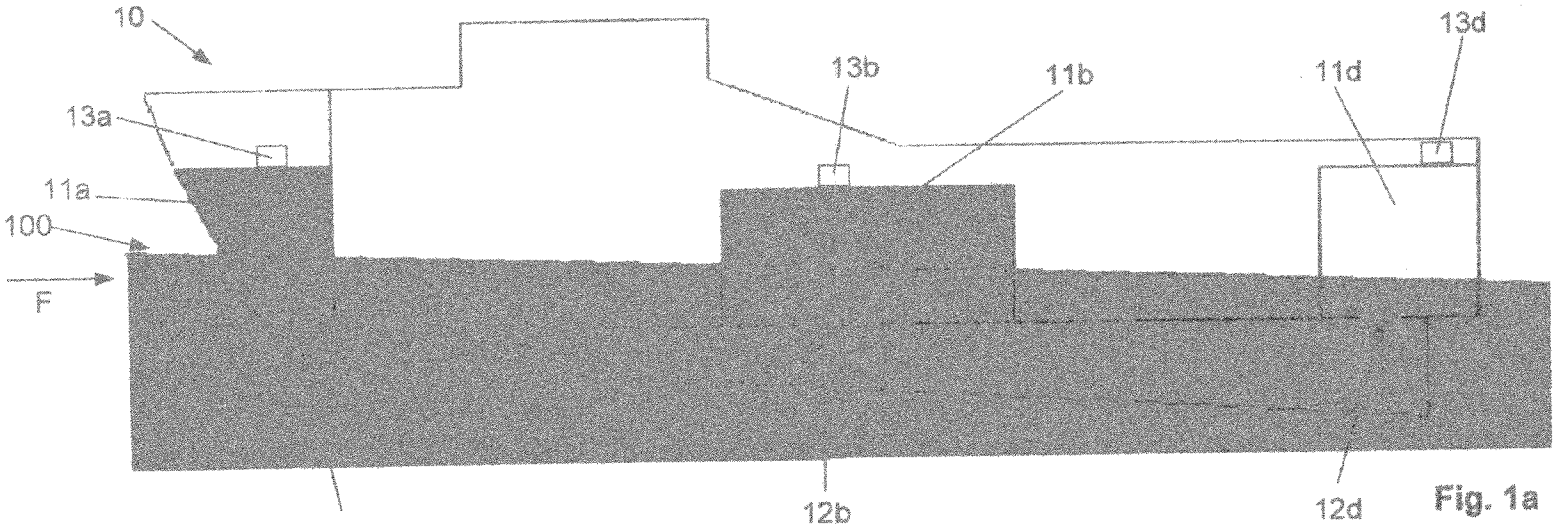
FIGS. 1*a* and *b* show an example of a vessel in one state, seen in cross-section from the side and above, respectively, FIGS. 2*a* and *b* show the vessel in FIGS. 1*a* and 1*b* in another state.
Figure 1B:
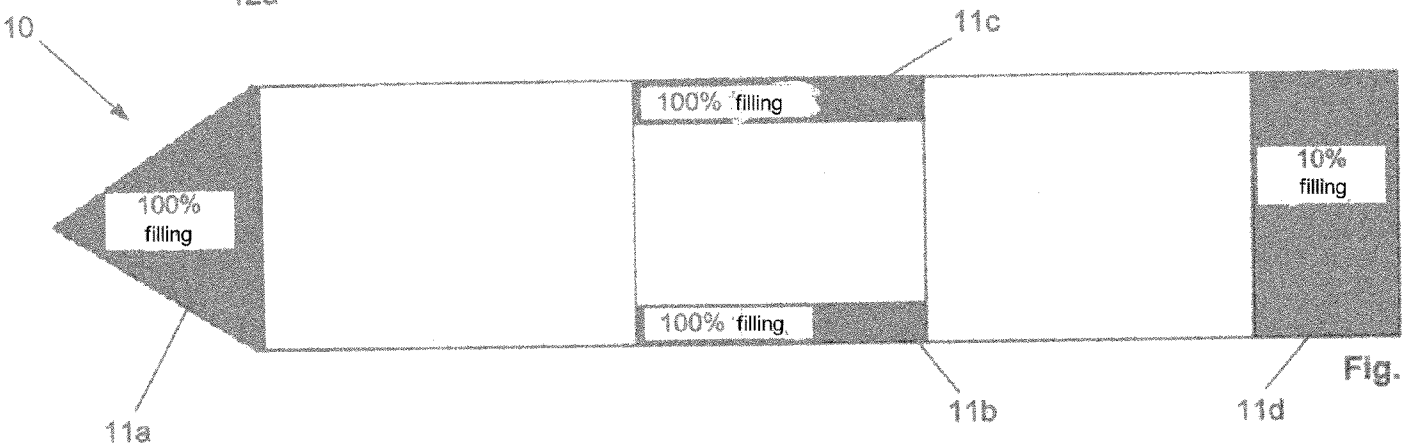

FIGS. 1*a* and 1*b* show an example of a vessel 10, where the system according to the invention is arranged. The system includes, for example, four tanks 11*a-d*, which tanks are arranged at suitable locations in the vessel 10, where, as an example, one tank 11*a* is arranged in the front of the vessel 10, two tanks 11*b* and 11*c* are arranged at each side, near the middle of the vessel 10, and one tank lid is arranged at the rear of the vessel 10. In this way the vessel, by means of the tanks 11*a-d*, will be able to counteract the effects of the environment, such as waves hitting the vessel alongside or abeam, or combinations of this.

Each tank 11*a-d* is adapted to the actual vessel 10, as regards size (volume), shape and height above the fluid level in which the vessel is floating, such as the sea level, which tanks are provided with openings 12*a-d* at the bottom. The openings 12*a-d* are large enough for a sufficient volume of fluid to pass without cavitation or other resistance in the openings of the tanks.

There will be a limitation of approximately 8 metres height of the fluid in the tanks 11*a-d*, due to the physical laws for vacuum in fluids, and for preventing the vacuum from evaporating the fluid instead of providing elevation. The higher the vacuum that will be necessary in the tanks, the less favourable it will be as regards economics/energy. The larger the surface the tanks 11*a-d* have, the less need for energy is required to achieve a high filling. As regards a vessel, a tank in the front of the vessel will in any case be higher than a tank in the middle of the vessel, this is because when sailing the waves affect changes at the front of the vessel more than in the middle of the vessel.

The location of the tanks 11*a-d* will be dependent of which vessel 10 it is, and the properties which are desired for the vessel 10. The tanks 11*a-d*, which are to be operated to avoid pitch and roll, are most effective the further out in the outer points of the hull they are arranged, while the tanks 11*a-d* which are to be operated to control the draught of the vessel, are most favourably arranged in the centre of the vessel 10.

The further down in the vessel the openings 12*a-d* are arranged, the more stable will be the control of the vacuum/pressure in the tanks 11*a-d*.

Further, the tanks 11*a-d* are provided with means 13*a-d* to control the volume of fluid in the tanks, which means 13*a-d* preferably are vacuum compressors or similar, which means 13*a-d* are used to control the pressure/vacuum of the fluid surface, and in this way to lower or elevate the fluid level to provide buoyancy, respectively ballast, in the tanks 11*a-d* for the vessel in different positions. The means 13*a-d* are preferably arranged outside the tanks 11*a-d*, for easy maintenance. The tanks 11*a-d* may also be emptied of fluid by supplying atmospheric pressure to the upper part of the tanks 11*a-d*, if the situation so permits and in this way there is no need for input power to empty the tanks 11*a-d*.

To control the system and to provide information on the state of the tanks 11*a-d*, the tanks 11*a-d* are further provided with measuring means (not shown), such as pressure sensors/meters, floats, pressure pulses or similar to provide information on the status of the tanks 11*a-d* to a control system.

The system further includes, as mentioned, a control system, which is provided with software/algorithms and/or programmed for controlling the means 13*a-d* for controlling the fluid level in the tanks 11*a-d*, in relation to the future movements of the vessel 10, especially the vertical movement, which can be divided into roll, pitch and draught.

The control system will receive information from the means informing on the state in the tanks at any time, and information on the movements of the vessel. Information on the movements of the vessel can, in one embodiment, be provided from a MRU (Motion Reference Unit) and a VRU (Vertical Reference Unit), preferably with gyro stabilization, or similar means providing information on vertical movements of the vessel. If the vessel is equipped with a DP system, the control system can be provided with direct input from this.

Figure 4A:
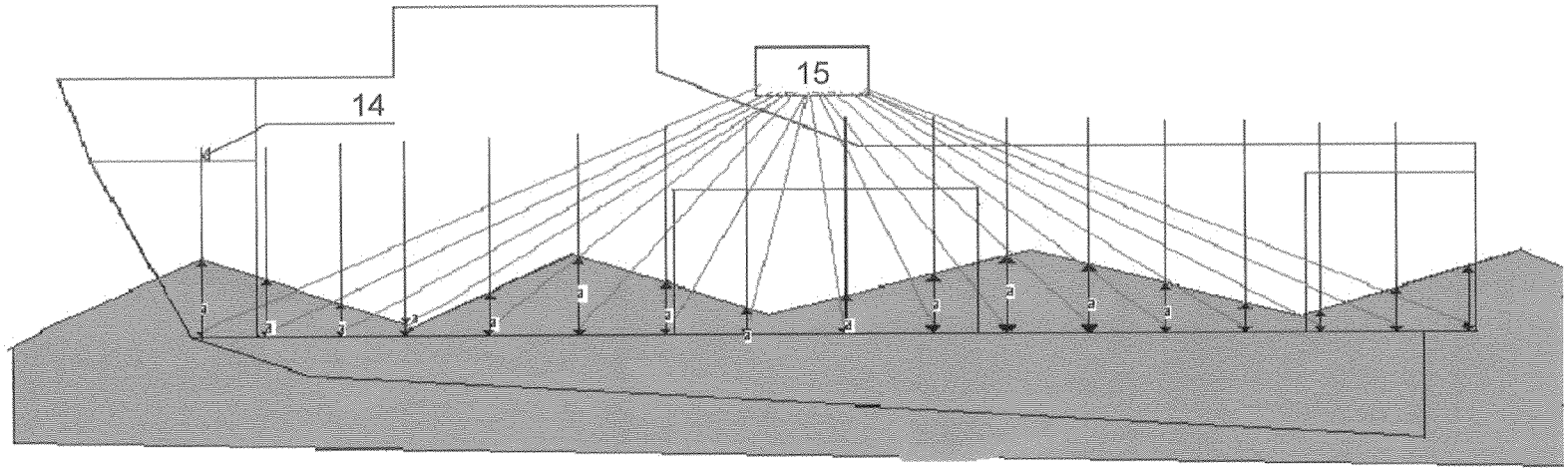
FIGS. 4*a-b* show a vessel provided with a sensor means at the vessel side, FIGS. 5*a* and *b* show an example of how the system can utilize a separate wave, and FIGS. 6*a* and *b* show an example of the use of a fixed propeller in the opening of the tank.
Figure 4B:
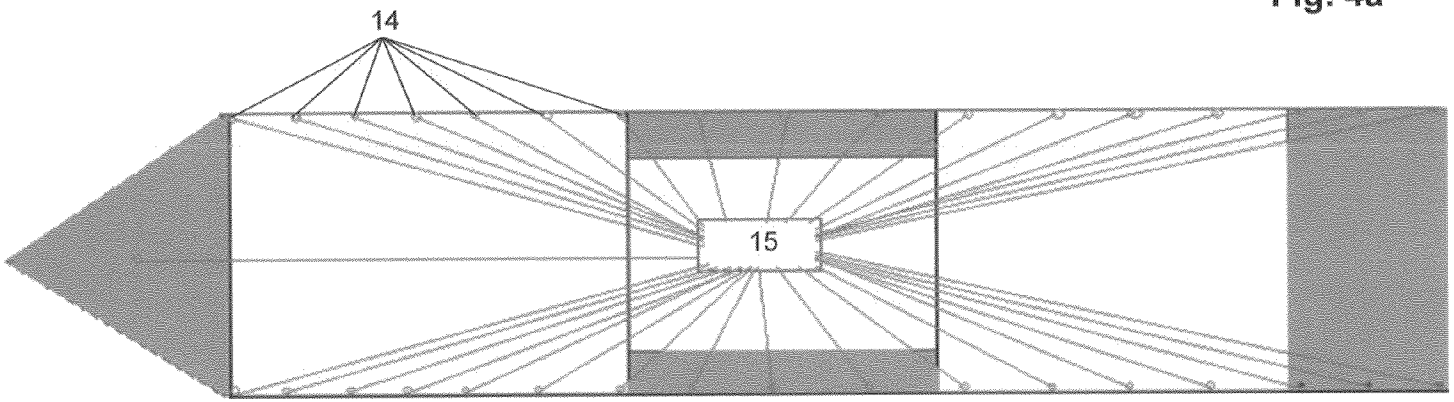

In addition the vessel is preferably provided with sensor means 14 (see FIGS. 4*a* and 4*b*), such as pressure sensors, radar and/or laser and/or wave calibration or similar means, which means 14 preferably are arranged along the sides of the vessel to provide information on wave height and frequency. In the example shown, the means 14 are in the form of wave calibration. Wave calibration is based on level tubes, which preferably are arranged vertically along the vessel side. The reference point at the lower part of the level tubes is the horizontal trim of the vessel. By arranging a level sensor in each tube, the wave height in can be read out at this point at each tube. To indicate a wave direction movement by this principle, a minimum of three sensors must be used. Provided that there is a minimum of three sensor tubes in each wave frequency, it will be possible to read off the wave direction. By calibrating and synchronizing the level of each sensor between the starboard side, the port side and the front of the vessel, the actual direction of the wave affecting the vessel at any time can be determined at any time. This principle can also be used to calculate the changing fluid volume/displacement which affects the hull movement in relation to the vertical movements of the vessel, such as: LCB—longitudinal centre of buoyancy, VCB—vertical centre of buoyancy and LCF—longitudinal centre of floatation.

In this way the control system can be provided with information to provide a picture of wave frequency, the direction of the wave and the total changing buoyancy produced by the wave. The information provides opportunities to predict the influence of the wave before the vessel starts to respond.

The information from the sensor means 14 are preferably monitored by a separate unit 15, which arranges the information for the control means.

The control system processes the information received and then calculates the settings for the means 13*a-d*, which then sets the right pressure and/or vacuum in the actual tanks 11*a-d*.

A vessel 10 provided with a system according to the invention will be better able to counteract the influence of the environment around the vessel, such as waves and other external factors affecting the vessel. The vessel will also be better able to maintain its position than purely by the use of propellers and thrusters, which are common for present vessels. It will also result in reduced energy costs, as a system like this requires fewer resources than for the use of thrusters and propellers, as the vessel, to a lesser extent, will be affected by the environment around the vessel, such as waves. It is, for example, for offshore vessels provided with a DP system, the DP system which maintains the vessel in position, while the system according to the invention counteracts the effects from the environment on the vessel, such as the effects of waves, which mainly are related to vertical movements.

FIGS. 1*a-b* illustrate an example of how a wave hits a vessel 10 lying in position, alongside in the bow with a force F. E.g., the vessel lies in position in relation to another vessel or another offshore installation (not shown). From, for example, the calculations of the DP system of the vessel movements or information from a MRU and a VRU, and information from measuring means in the tanks and sensor means along the vessel sides, the control system according to the invention calculates the ratio of filling in the different tanks 11*a-d*, which is necessary for the vessel to be affected as little as possible by this wave. This results, in this example, in that the control system, on the basis of given parameters, sends control signals to the means 13*a-d* about the ratio of filling for the different tanks 11*a-d*. To withstand the buoyancy provided by the wave, the tanks 11*a-c* are, for example, filled 100%, while the tank 11*d*, at the stern end of the vessel 10, will not be affected to the same extent of the wave and is only filled to 10%. The system can thus provide the necessary ballast in the front of the vessel to maintain the vessel 10 in a vertical position, i.e., for example, maintaining the same direction, the same distance to the seabed or the same distance in relation to the offshore installation. As an illustrating example, we can consider that a vessel 10 must have a tank 11*a* in the front of the vessel containing 200 $m^3$ ballast to compensate for the changes in the buoyancy in the front of the vessel with waves of 3 metres, as illustrated in FIGS. 1*a-b*.

If the wave frequency in a given example is 10 seconds, this will result in that the tank 11*a*, for example, must be filled with 200 $m^3$ in 10 seconds, which results in that the fluid level in the tank 11*a*, for example, must be elevated by 4 metres in relation to the fluid level 100 in which the vessel is floating, i.e. the sea level. This can according to the invention be performed rapidly by using a vacuum compressor 13*a* arranged in connection with the tank 11*a*, as described above. The vacuum compressor 13*a* provides a negative pressure at the upper part of the tank 11, resulting in fluid being sucked in through the openings 12*a* into the tank 11*a* to balance the pressure.

A vacuum compressor which, for example, is operated by a 200 kW motor will be able to do this. By way of comparison, a traditional sea water pump, such as an Anti heeling pump, will need a capacity of ca. 72 000 $m^3$/hour to supply the same volume. To operate such a pump, a motor of ca. 3850 kW would be required. This shows that large savings in energy consumption can be made here, and that it will not be possible to achieve a similar system as the invention by the use of prior art technology. In addition there are also problems with pumps which are to operate in sea water, as there could be corrosion problems for pumps, as sea water is a corrosive medium, and water must be continuously pumped in or out of the tank which must in this case be closed at the bottom. It also means that this fluid volume reduces the load-carrying ability of the vessel.

Open ballast tanks will, by definition, also reduce the total dead weight, provided that there is not a valve at the bottom of the tank which can be closed. Many considerations, on the other hand, show that it would be favourable to provide the tanks with means for closing the opening at the bottom. Even though a ballast tank, which is open at the bottom, and with double securing at the top of the tanks to prevent the air in the tank from escaping will theoretically maintain the buoyancy as if the tank had a valve at the bottom. By incorporating a means for closing, such as a valve or similar, at the bottom of the tank, it will be possible, when not using active stabilization, to close the valve and use the vessel as usual. Even though, by experience, it is known that such a valve will leak, a stop valve can be used on the compressor tube which is connected to the tank. The air will then be held in the top of the tank so that the water only can compress the air in the tank, and the buoyancy will be the same as if the tank was closed in the bottom. (By incorporating air tubes into all bottom tanks on existing vessels, this can contribute to preventing vessels which sail in shallow water from becoming grounded and damaging the ballast tanks.)

Figure 2A:
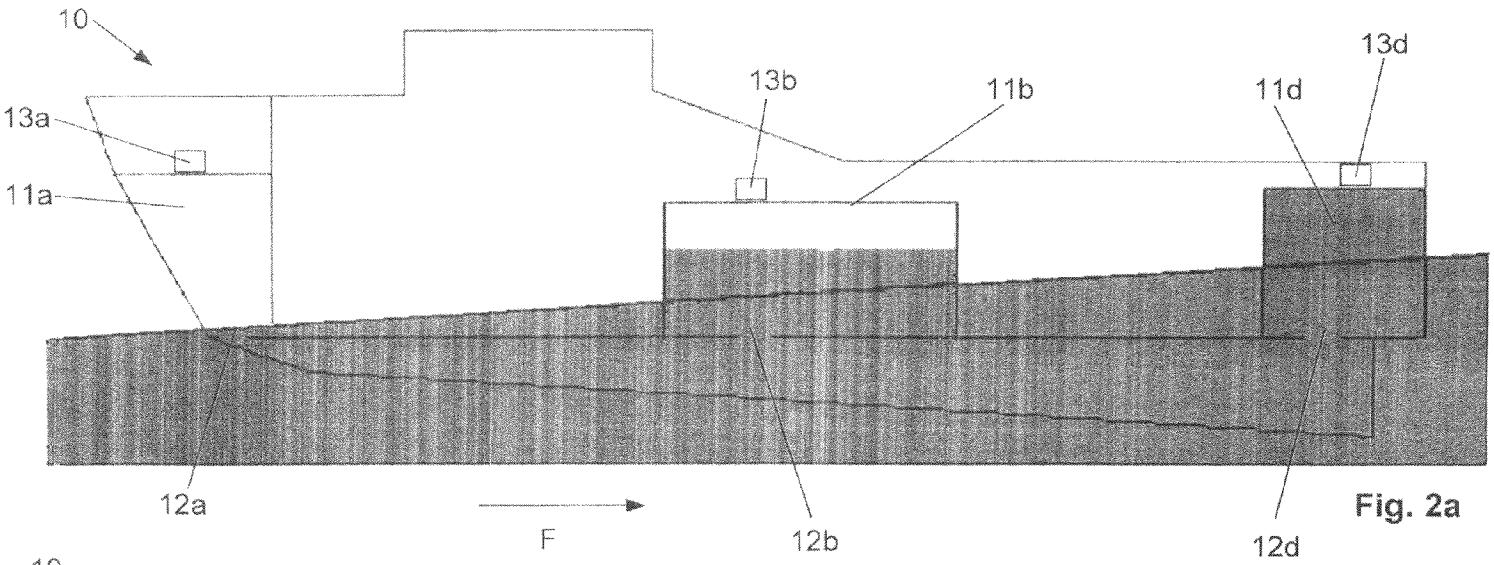
Figure 2B:
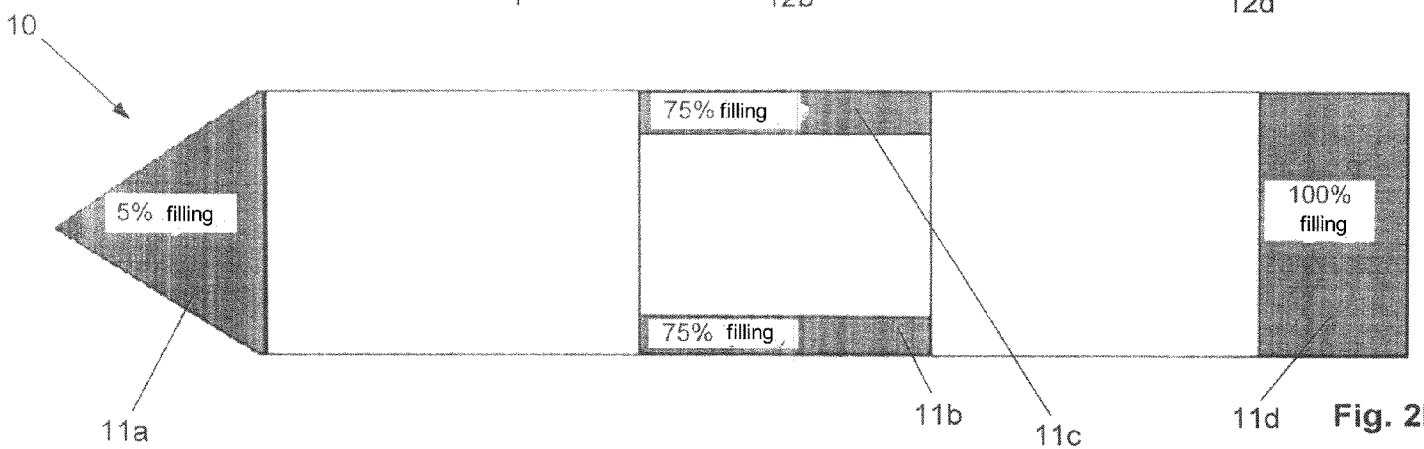

As the wave in the example passes along the vessel, the need to change the buoyancy/ballast in the different tanks 11*a-d* to counteract the influence of the wave changes. FIGS. 2*a* and 2*b* illustrate a situation in which the top of the wave is passing the stern end of the vessel. From the calculations of the DP system of the future movements of the vessel, and/or information from a MRU and a VRU, and information from the measuring means in the tanks and sensor means arranged along the vessel sides, the control system according to the invention calculates the ratio of filling in the different tanks 11*a-d* which is necessary for the vessel to be affected as little as possible by the wave, in the situation described. The result of this is that the control system based on given parameters send control signals to the means 13*a-d* about the ratio of filling of the tanks 11*a-d*. As the vessel 10 here is affected the most by the wave at the stern end of the vessel, tank 11*d* in the stern end of the vessel is filled 100%, while the tanks 11*b-c* near the middle of the vessel are filled with 75% and the tank 11*a* in the front of the vessel is filled 10%. In his way the system according to the invention can counteract the forces from the wave affecting the vessel, and maintain the vessel 10 in a stable vertical position, i.e. maintaining the same direction, the same distance from the seabed and maintaining the same distance in relation to the offshore installation. If the tank 11*d* has the same parameters as where used for tank 11*a*, the same calculations as for tank 11*a* will provide the same result for tank 11*d*. Similar calculations may as well be performed for the two tanks near to the middle of the vessel.

As the tanks 11*a-c* here shall reduce their fluid volume in relation to the situation in FIG. 1*a-b*, pressure must be supplied above the fluid surface in the tanks 11*a-c*. If the openings 12*a-c* in the tanks 11*a-c* are large enough to empty the tanks within 10 seconds, as was the wave frequency in the example above, atmospheric pressure can be used. In this way no power will be needed to empty the tanks. In this way, the power consumption in the given example will only be the half of the power consumption of the vacuum compressor within a period for the tanks 11*a* and 11*d*, while it will be substantially less for the tanks 11*b* and 11*c*, in a given period where the vessel lies in position in relation to a offshore installation with uniform environmental conditions. If there is need for changes which resulting in a need for buoyancy in one of the tanks, the vacuum compressor can add extra pressure in the tanks and thus contribute to increased buoyancy in the tanks. As mentioned above the tanks can be provided with means for closing the openings of the tanks if required.

Figure 3:
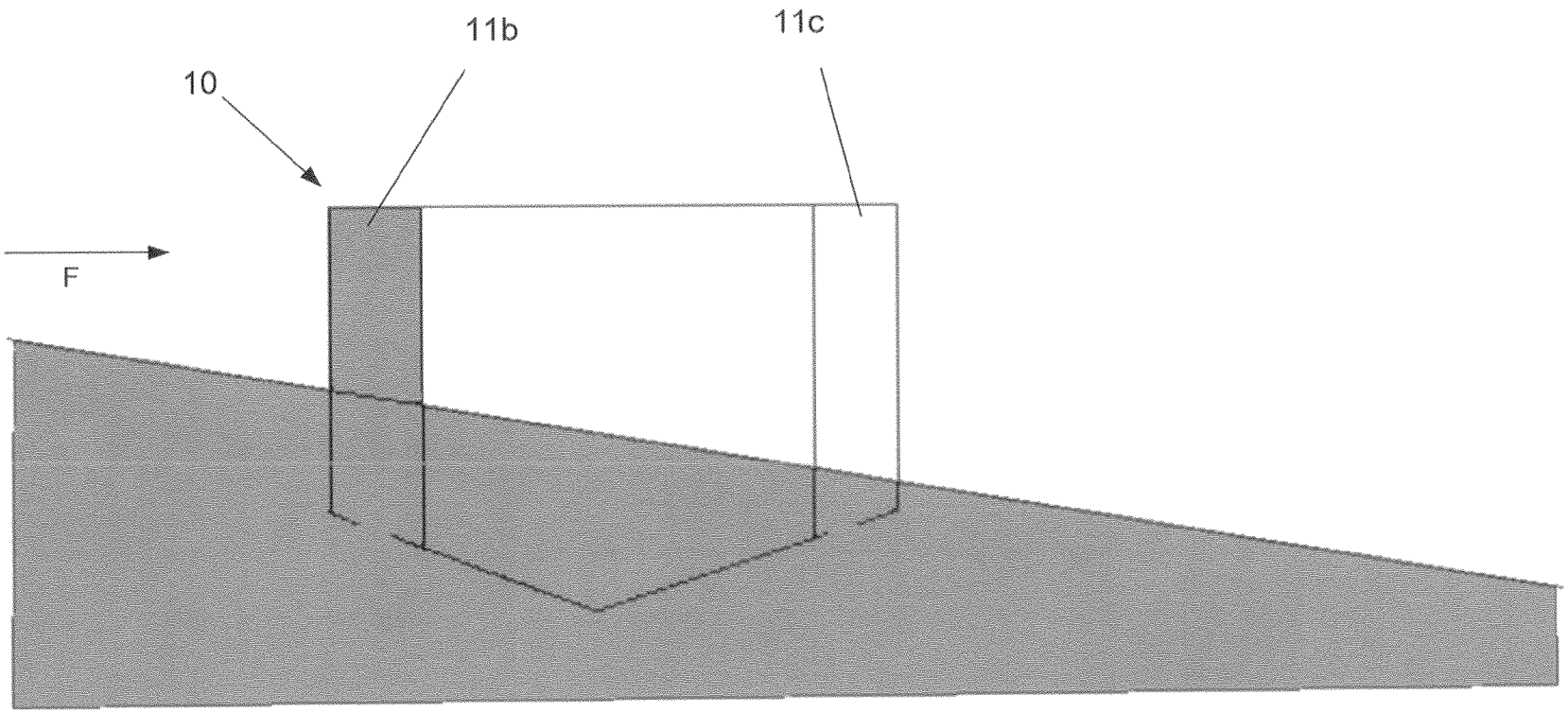
FIG. 3 is a cross-sectional view of the vessel in FIGS. 1*a-b* and 2*a-b*, through a middle section of the vessel in FIGS. 1*a-b* and 2*a-b*, in a third state.

Referring now to FIG. 3, this is a cross-section through the middle section and the middle of tanks 11*b* and 11*c* of a vessel provided with a system according to the invention. In this case, illustrated is an example which shows a wave hitting the vessel 10 abeam with a force F. The system according to the invention will here fill the tank 11*b*, which lies closest to the strike side of the wave, entirely, providing the vessel 10 with ballast on port side and thus counteracting the forces from the wave and preventing tilting. In this way the vessel maintains an approximately horizontal position. As the wave passes over to the starboard side and provides total buoyancy on the hull, the total ratio of filling for tank 11*b* and 11*c* must be changed, and tank 11*c* must thus be filled and tank 11*b* emptied to counteract the forces from the wave.

Figure 5A:
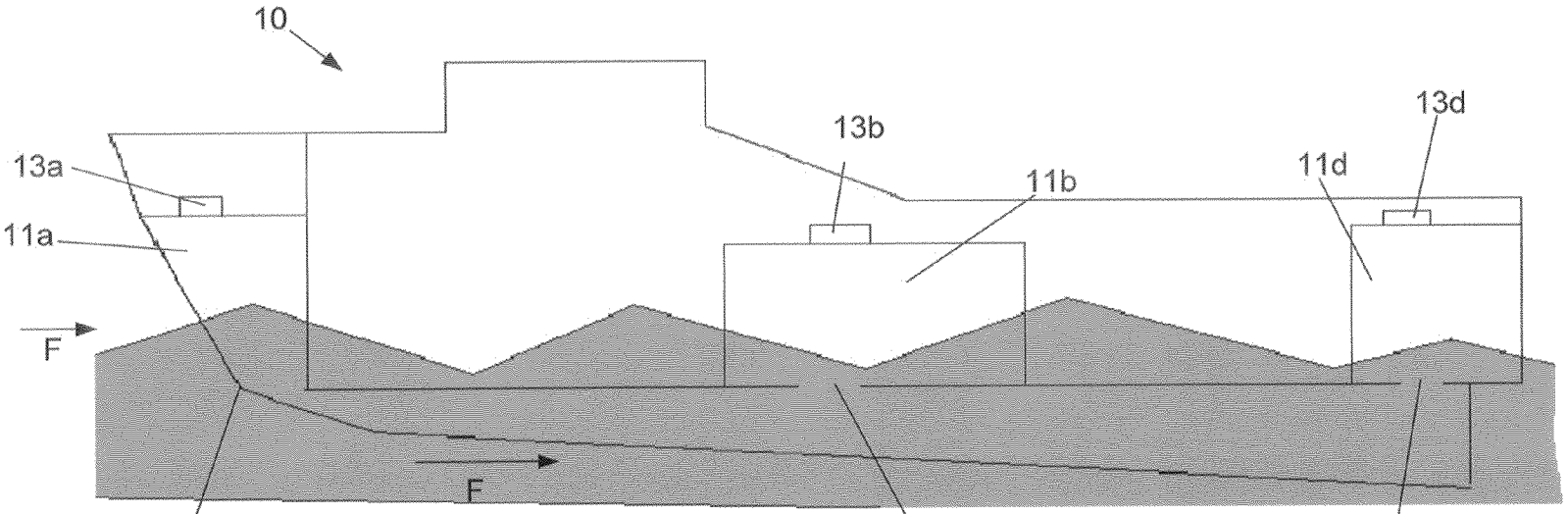
Figure 5B:
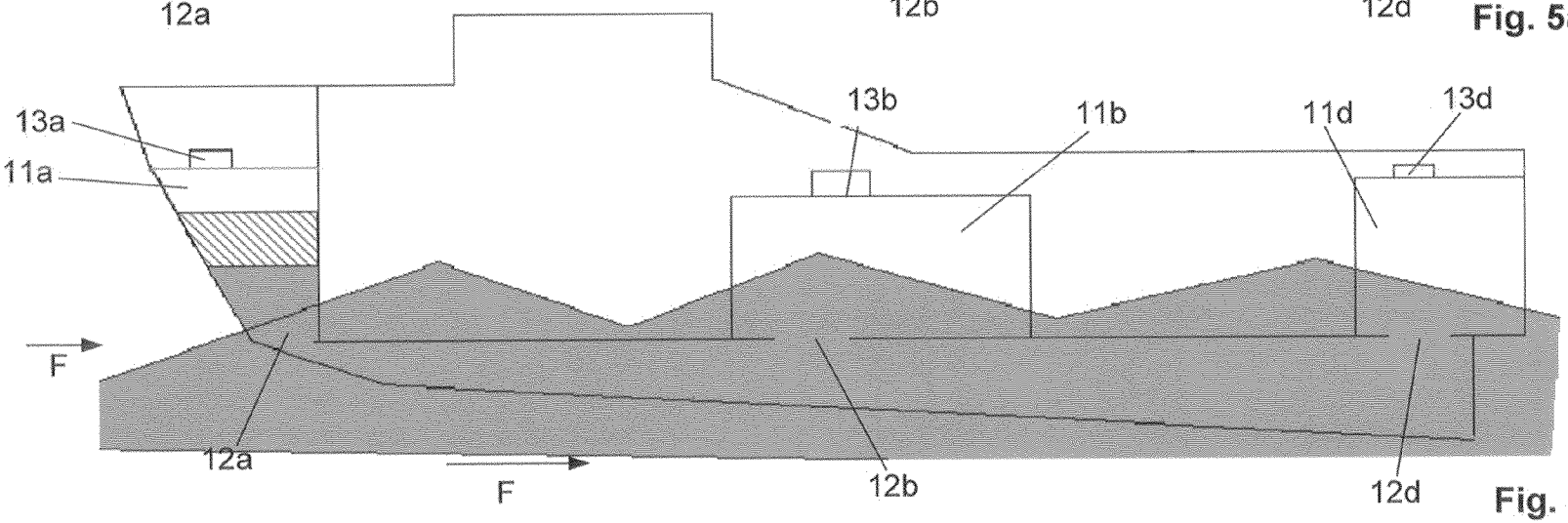

FIGS. 5*a* and *b* illustrate that the system according to the invention is energy saving. The system according to the invention can utilize a separate wave striking, for example, tank 11*a*, as shown in FIGS. 5*a-b*. The vacuum compressor 13*a* or an exhaust valve 13*a* can make the tank 11*a* without pressure at entering the wave and the fluid flows freely into the tank 11*a*. The tank 11*a* thus results in no buoyancy due to the wave striking the first area of the vessel, while the height of the wave will determine the ratio of filling of fluid in the tank 11*a*. As the wave continues further to the back, towards the hull, the wave will affect the buoyancy of the vessel. The vacuum compressor 13*a* then receives a signal to increase the vacuum in the tank 11*a*, which thereby provides the tank 11*a* with the desired fluid weight to reduce the buoyancy of the passing wave. This is illustrated in FIG. 5*b*, which shows the tank 11*a* being gradually filled with ballast due to the wave (grey scale) and further ballast supplied by the vacuum compressor 13*a* is shown as shaded area in the tank 11*a*.

A method for active stabilization of a vessel by utilizing a system according to the invention will now be described in more detail.

A method for active stabilization of a vessel includes the following steps:

1. Acquiring information on the movements of the vessel from a MRU (Motion Reference Unit) and/or a VRU (Vertical Reference Unit) and/or a DP system or similar,
2. Acquiring information on the state of the tanks of the system,
3. Based on information from the steps 1 and 2, calculating the ratio of filling for the different tanks by means of a control system according to the invention, i.e. if vacuum or pressure is to be supplied, where pressure only is supplied if the level of the tank is to be lower than the fluid level in which the vessel is floating,
4. Providing means for controlling vacuum and pressure in the tanks with settings based on the calculation in step 3,
5. Supplying pressure or vacuum to the tanks by means of means for controlling the fluid volume in the tanks, until means for information on the status of the tanks responds to the control system according to the invention that the desired pressure or vacuum is achieved,
6. Repeating the steps 1-5.

Step 1 includes acquiring information from a MRU (Motion Reference Unit) and a VRU (Vertical Reference Unit), a DP system or similar, which information includes information on the movements of the vessel, and/or information on wave height and frequency by means of suitable means, such as wave calibration. By means of this information, the vessel can be controlled to counteract these expected changes. A DP system is as mentioned mainly incorporated for controlling the propellers and thrusters of the vessel, but by means of the system according to the invention, the information on the movements of the vessel can be used for active and passive stabilization of the vessel, by supplying ballast or buoyancy to the vessel through adapted tanks arranged at adapted locations. This will provide entirely new possibilities for controlling the vessel.

As today there exist laws and rules for wind and sea movements, which set boundaries for when it is acceptable to carry out work on a vessel together with other vessels/installations, the invention will result in the vertical movements of the vessel being less affected by waves and wind, and that the vessels being able to work during poorer conditions and still be inside the statutory boundaries regarding waves and wind, which means that vessels would have less time to wait for calmer weather, before continuing with the work at hand.

Landing helicopters can also have an increasing movement problem, and the present invention can make a significant contribution to solving this problem.

Step 2 includes acquiring information on the state of the tanks of the system, which is a premise for the control system according to the invention to know if pressure or vacuum is to be supplied to the tanks.

The steps 1 and/or 2 can, in addition to acquiring information on the movements of the vessel, also include acquiring information on wave height and frequency, which information makes it possible for the control system to form a picture of wave frequency, direction of the wave and the total changing buoyancy provided by the wave. This is preferably performed by means of sensor means, such as pressure sensors, radar and/or laser and/or wave calibration or similar means, preferably arranged along the sides of the vessel.

Step 3 includes the calculation of the ratio of filling in the tanks based on the information acquired in steps 1-2, and predefined parameters. The ratio of filling is controlled by supplying vacuum and/or pressure in the tanks. If a tank is to be provided with ballast, the system will calculate how much vacuum is needed to achieve the desired ballast and thereby fill the tank with fluid. If a tank is to be provided with buoyancy, the system will calculate how much pressure is needed for supplying the tank to achieve the desired buoyancy.

The control system according to the invention will in advance be provided with predefined parameters for the properties of the vessel and the properties of the system. Different vessels will have different properties, different tanks, different capacity for vacuum compressors, etc., and the control system thus includes parameters so that the desired behaviour and properties are achieved for the vessel. The control system also includes security margins and other security instructions which have to be followed if a critical situation occurs. The control system is also provided with possibilities for manually changing the parameters, so that the vessel can be provided with desired properties in relation to the desired behaviour. The system can also be provided with special means for critical situations, such as the tanks being provided with a throttle at the top, which rapidly evacuates the vacuum in the tank and the fluid will thus flow out. It will also in many conditions be relevant to have an extra standby compressor for each tank, which will take over if something should happen with the compressor.

The system can also be arranged so that, for example, if the draught movement is critical for the vessel during an operation, the system will be arranged to compensate additionally for this if a critical situation occurs. This is similar to sailing in shallow waters as described above.

Steps 4 and 5 include providing the means for controlling vacuum and pressure in the tanks with settings to achieve the desired ballast or buoyancy in the tanks. Pressure or vacuum is supplied to the tanks until means for information on the state in the tanks respond to the control system that the desired vacuum or pressure is achieved.

Step 6 includes repeating the steps 1-5. As the situation of the vessel and the environment continuously change, the system according to the invention must also continuously change, so that the vessel exhibits the desired behaviour. The system according to the invention thus provides a closed loop control, which is self correcting.

The system can also function as passive stabilization for a vessel provided with a system according to the invention. When a vessel travels into the tide, and a controlled airing at the top of the tanks has been calculated, the tanks will be filled according to the height of the sea. As the vessel then has the greatest filling in the tanks, it will have the greatest draught at the point in question. As the vessel starts to rise due to the shape of the hull and the buoyancy behind tank 11*a*, the airflow to the tank is closed, so that the vessel is weighted in such a way that it will be prevented from rising, but this weighting will be dispersed by the time the vessel reaches its uppermost movement by opening the airflow of the tank so that the fluid flows out immediately. That is to say that use is made of both the static movement the vessel gets due to the wave and variations of the level of the wave outside the hull. This change between reducing the buoyancy and fluid flowing freely into the tank, and in the next moment the free fluid which has flowed into the tank is retained as ballast. In this way, the passive stabilization will work in the same way as a shock absorber on a car. The opening ratio of the airflow will naturally be controlled and automated by the control system, so that the system finds the best opening ratio to prevent excessive wear on the mechanical parts of the system.

When the system according to the invention is to be used as a passive system, use can be made of the information which already is present at active stabilization, to operate a valve at the top of the tanks, instead of controlling a vacuum compressor. A closed valve corresponds to maximum power of the compressor and an open valve corresponds to minimum power of the compressor.

A method for passive stabilization according to the invention can be summarized in the following steps:

1. Acquiring information on the movements of the vessel from a MRU and/or a VRU and/or a DP system or similar, which provides information on the movements of the vessel,
2. Acquiring information on the state in the tanks of the system,
3. Based on information from the steps 1 and 2, calculating if the tanks should have ballast or increased buoyancy,
4. Providing means for controlling the fluid amount in the tanks with settings to open as it is required to reduce buoyancy in tanks and/or to close these as required to increase buoyancy in the tanks,
5. Continuously repeating the steps 1-4.

The steps 1 and/or 2 can also here, in addition to acquiring information on the movements of the vessel, preferably also include acquiring information on wave height and frequency, which information is acquired by suitable means, such as pressure sensors, radar and/or laser and/or wave calibration or similar means, which means preferably are arranged along the sides of the vessel to provide information on wave height and frequency.

If the information is not present, the valve must be adjusted manually for the best possible effect by trial and experience, in the same way as is done in an anti rolling stabilization tank, which is filled up according to experience and conditions. For an adjustable shock absorber on a car, the nozzle opening changes size, and in the same manner a valve can be adjusted for the best possible effect for the pitch of the vessel.

Modifications

The tank according to the invention can have a different shape, size and height, and must be adapted to each vessel. In addition each vessel will have a desired behaviour and properties, which system according to the invention must be adapted for the achievement of the desired behaviour and properties.

Means for controlling the buoyancy and ballast in the tanks are preferably vacuum compressors/pumps, but the tanks can also be filled by using, for example, a horizontal side propeller arranged in the lower part of the tank, which is the opening of the tank.

To use a horizontal side propeller at the bottom of the tank is considered less favourable even though the supply capacity may be possible:

1. The propeller must operate under water,
2. The vessel must go to dock for operations,
3. Possibilities for leakage and contaminations,
4. Greater maintenance costs,
5. Dependent on service crew for maintenance,
6. Greater investment costs,
7. More expensive installation.

Figure 6A:
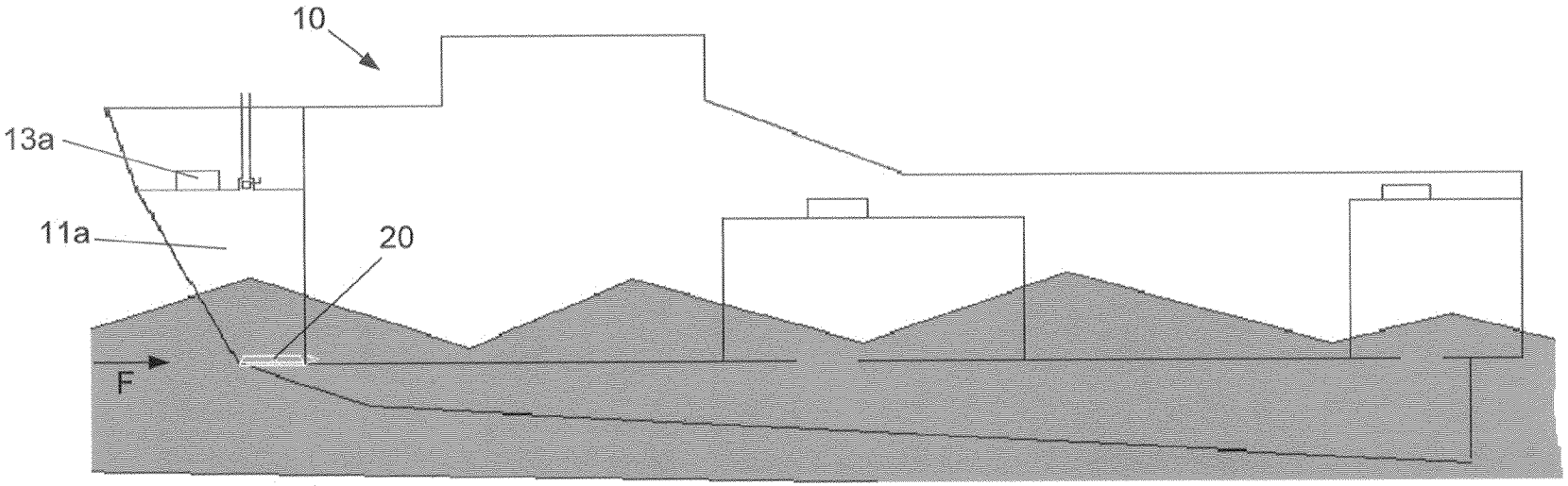
Figure 6B:
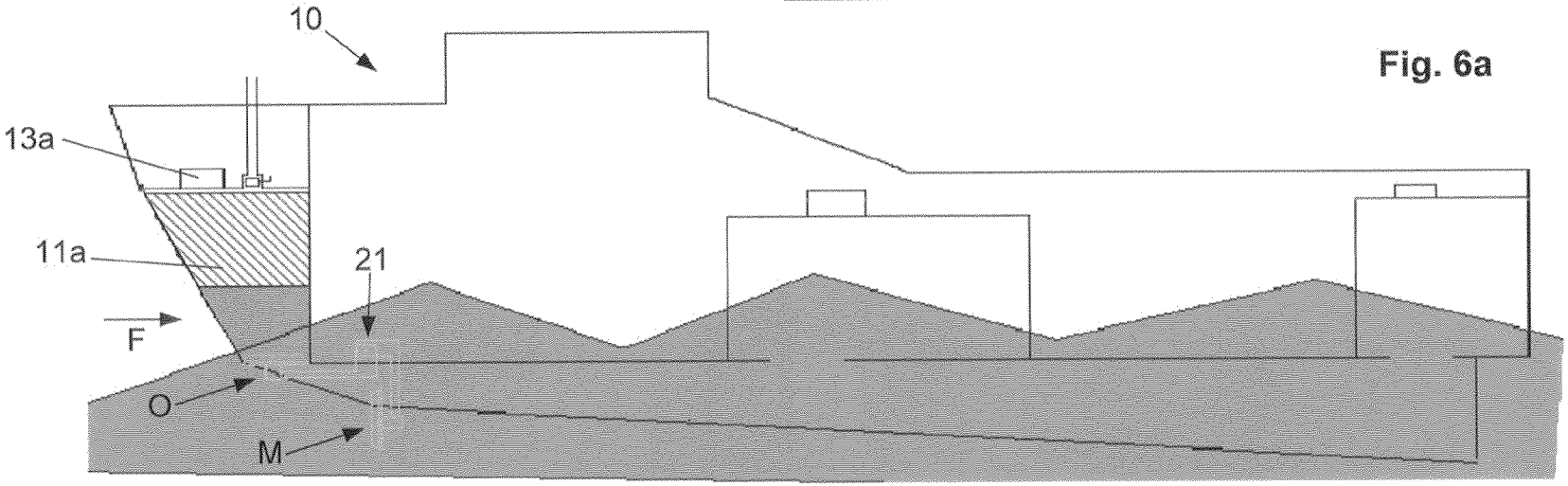

Referring now to FIGS. 6*a-b*, which show an example of this. A horizontal propeller arranged in the openings 12*a-d* of the ballast tanks 11*a-d* (only shown for tank 11*a*), which propeller 20 can be a similar to the side propeller principle with adjustable pitch of the propeller blades. The propeller blades can be controlled for possible filling or emptying the tanks 11*a-d*. The propeller blades can be formed so that if they are operated to a zero condition, they close the opening of the tank. A retractable Azimuth propeller 21 can also be used in a situation as described above. With a retracted Azimuth propeller 21, which is not used for manoeuvring operations, it can be tilted so that the propeller nozzle becomes a joint with the tank opening in the bottom of tank 11*a-d*. This can then be used for filling and emptying fluid from the tanks 11*a-d*. FIG. 6*a* shows a fixed propeller in the opening of the tank 11*a*, while FIG. 6*b* shows a retractable Azimuth 21 in a lower position M for manoeuvring use, and in a retracted position O for filling and emptying the tank 11*a*.

At their openings, the tanks can be provided with means for closing the tanks, for example, to provide buoyancy.

A vertical side propeller at the bottom of the tank can also be used to close the tank by that it includes specially shaped propeller blades and hub, which results in that if its pitch are operated in a special zone, an entirely closed construction is achieved, almost as a valve.

It will also be possible to use a hydraulic valve for this purpose, e.g. by designing a hydraulic valve shaped as a propeller.

A "Vross", which is a submersible propeller, can in standby mode (open position), be arranged to cover exactly an opening in the bottom of the stabilization tank, and in this way it can ensure the changing of the fluid amount in the stabilization tank. This can replace the vacuum compressors or be used in addition to the vacuum compressors.

The existing compressors in the present system can also be used to secure all ballast tanks with air supply. In the event of possible accidents, which result in damage in the hull or sides of the vessel, the compressors can supply sufficient air to the damaged tank to maintain the original buoyancy in the tank, so that the vessel is prevented from tilting and possibly sinking. The damaged tank must be arranged with a stop valve to the tanks conventional airflow.

Vessels provided with brine, mud and cement tanks can use these as buffer tanks for vacuum and air pressure to prevent rapid changes of the compressor load.

Vacuum compressors can also be used to transport cooling water from sea chests and via the cooler of the vessel. In this way there is no need for the use of traditional seawater pumps.

A vacuum compressor can be used instead of traditional drainage pumps and oil/water separators.

A cylindrical tank which can withstand vacuum and pressure loads can be connected to a vacuum compressor, which has pipe connections to the bilge pumps of the vessel. At negative pressure, this can be used instead of present drainage pumps. Under closed valves to the bilge pump, the vacuum compressor will evaporate the water from the contaminated bilge water and lead the pure water vapour out to the atmosphere. After the removal of water from the contaminated bilge water, the vacuum in the tank is reversed to an overpressure and the valve is opened to empty the tank into a sludge tank. In this way, by means of the present invention, the oil/water separator which is extremely difficult to get to work satisfactorily according to the new regulations for pumping bilge water overboard, which is at maximum 5 ppm, can be removed.

It should be mentioned that the above latter modifications can only be performed when the vacuum compressor has sufficient free capacity.

The invention claimed is:

1. System for the active and passive stabilization of a vessel (10), which vessel (10) is provided with a plurality of independent separate tanks (11*a-d*) to provide buoyancy and/or ballast, which separate tanks (11*a-d*) are provided with openings (12*a-d*) in the bottom, which openings (12*a-d*) are facing the medium the vessel (10) is floating in, which separate tanks (11*a-d*) are independent of each other, wherein the plurality of separate tanks (11*a-d*) are separately and independently controllable of each other and are arranged in such a way that they have an extension so that a main part of the separate independent controllable tanks (11*a-d*) extends above a fluid level the vessel (10) is floating in, and a minor part of the separate independent controllable tanks (11*a-d*) extends below the fluid level the vessel (10) is floating in, as the vessel (10) is floating in normal conditions without any loads, wherein each of the plurality of separate independent controllable tanks is provided with a vacuum/pressure (13*a-d*) compressor configured for large changes of pressure in an associated tank, and a valve configured for small changes of pressure in an associated tank for providing positive or negative pressure in associated separate independent controllable tanks (11*a-d*) for the removal or supply of fluid, respectively, by directly adding positive pressure to the interior of associated separate independent controllable tanks (11*a-d*) to provide the vessel (10) with buoyancy, or directly adding negative pressure to the interior of associated separate independent controllable tanks (11*a-d*) to provide the vessel (10) with load independent of the vessel movements, which vacuum/pressure (13*a-d*) compressors and valves are independently controlled to counteract the effects of external forces on the movements of the vessel (10).

2. System according to claim 1, characterized in that the system further includes separate means to provide information on the state in the associated separate independent controllable tanks (11*a-d*).

3. System according to claim 1, characterized in that the system further includes means for finding information on the movements of the vessel which provides information on the movements of the vessel (10), mainly the vertical movements.

4. System according to claim 1, characterized in that the system further includes sensing means (14) arranged along the sides of the vessel to provide information on wave height and frequency.

5. System according to claim 3, characterized in that the system includes means for predicting the movements of the vessel based on information on the movements of the vessel and/or the sensing means (14) in order to counteract the wave movements before the vessel is affected by the wave.

6. System according to claim 1, characterized in that the system further includes a control system to control the fluid volume in the separate independent controllable tanks (11*a-d*), by providing negative pressure in the independent controllable tanks (11*a-d*) for load or positive pressure for buoyancy.

7. System according to claim 1, characterized in that the separate independent controllable tanks (11*a-d*) are adapted to the vessel (10) as regards size and shape to available space in the vessel (10), and are arranged close to the front, rear and/or middle parts of the vessel (10) to provide the vessel (10) with the desired properties.

8. System according to claim 6, characterized in that the control system is arranged to calculate current load and/or buoyancy for the different separate independent controllable tanks (11*a-d*), based on input from means for finding/predicting the movements of the vessel, and/or means for information on the state in the separate independent controllable tanks (11*a-d*), and/or sensor means (14) for information on wave height and frequency, and/or given predefined parameters for the behaviour of the vessel, and provide separate independent controllable means (13*a-d*) for supplying fluid to the associated separate independent controllable tanks (11*a-d*) with settings.

9. System according to claim 1, characterized in that the system is manual or automatic.

10. System according to claim 1, characterized in that the system further includes separate independent controllable means arranged to the openings (12*a-d*) of the separate independent controllable tanks (11*a-d*), to close the openings and/or supply fluid to the associated separate independent controllable tanks (11*a-d*).

11. System according to claim 1, characterized in that the free capacity of the vacuum/pressure compressors (13*a-d*) is used to:

provide bottom tanks of a vessel with air supply, or transport cooling water from a vessel's sea chest and via the coolers of the vessel, or evaporate water from contaminated bilge water and expel pure water vapour out in the atmosphere.

12. Method for active stabilization of a vessel (10), which vessel (10) is provided with a system according to claim 1, characterized in that it includes the following steps;

1. Acquiring information on the movements of the vessel,
2. Acquiring information on the state in the separate independent controllable tanks of the system,
3. Based on information from the steps 1 and 2,calculating the ratio of filling for the separate independent controllable tanks, including calculating if the pressure in the separate independent controllable tank is to be positive or negative,
4. Providing separate independent means for controlling the pressure in the associated separate independent controllable tanks with settings based on the calculation in step 3,
5. Increasing or decreasing the pressure in the separate independent controllable tanks by means of means for controlling the fluid volume in the separate independent controllable tanks, until means for the state in the separate independent controllable tanks respond to the control system according to the invention that the desired positive or negative pressure is achieved,
6. Repeating the steps 1-5.

13. Method according to claim 12, characterized in that step 1 includes acquiring information from a MRU (Motion Reference Unit) and/or a VRU (Vertical Reference Unit) and/or a dynamic positioning system, which information includes information on the movements of the vessel.

14. Method according to claim 12, characterized in that step 2 includes acquiring information on the state in the separate independent controllable tanks by suitable means for this which is a premise for the control system according to the invention to know if pressure or vacuum is to be supplied to the separate independent controllable tanks.

15. Method according to claim 12, characterized in that step 1 and/or 2 also includes acquiring information on wave height and frequency by means of sensor means for this, which information makes it possible for the control system to form a picture of the wave frequency, direction of the wave and the total changing buoyancy provided by the wave.

16. Method according to claim 12, characterized in that steps 4 and 5 include providing the separate independent controllable means for controlling the fluid amount in the separate independent controllable tanks with settings to achieve desired load or buoyancy in the associated separate independent controllable tanks.

17. Method according to claim 16, characterized in that the pressure in the separate independent controllable tanks is increased or decreased until means for the state in the separate independent controllable tanks respond to the control system that the desired pressure is achieved.

18. Method according to claim 12, characterized in that the steps 1 to 5 are continuously repeated for the vessel to adapt to the continuously changing environment, which makes the system self correcting.

19. Method for passive stabilization of a vessel, which vessel is provided with the invention according to claim 1, characterized in that it includes the following steps:

1. Acquiring information on the movements of the vessel,
2. Acquiring information on the state in the separate independent controllable tanks of the system,
3. Based on information from the steps 1 and 2,calculating if the separate independent controllable tanks should have reduced and/or increased buoyancy,
4. Providing separate means for controlling the fluid amount in the separate independent controllable tanks with settings to open a separate independent controllable valve for supplying fluid to the separate independent controllable tanks if reduced buoyancy in the associated separate independent controllable tanks is required and/or to close the separate independent controllable valve if increased buoyancy in the associated separate independent controllable tanks is required,
5. Continuously repeating the steps 1-4.

20. Method according to claim 19, characterized in that step 1 includes acquiring information from a MRU (Motion Reference Unit) and/or a VRU (Vertical Reference Unit) and/or a dynamic positioning system, which information includes information on the movements of the vessel.

21. Method according to claim 19, characterized in that step 2 includes acquiring information on the status of the separate independent controllable tanks, which is a premise for the control system according to the invention to know if positive or negative pressure is to be provided in the associated separate independent controllable tanks.

22. Method according to claim 19, characterized in that step 1 and/or 2 also include acquiring information on wave height and frequency by means of sensor means for this, which information makes it possible for the control system to form a picture of the wave frequency, direction of the wave and the total changing buoyancy provided by the wave.

23. Method for passive stabilization of a vessel according to claim 18, characterized in that if no information from step 1 and 2 is present, the separate independent controllable valve can be manually adjusted for best possible effect by trial and experience.

24. System according to claim 1, further comprising a computerized control system for controlling the separate independent controllable means.

25. Method according to claim 12, further comprising controlling the separate independent means using a computerized control system.

26. Method according to claim 19, further comprising controlling the separate independent controllable means using a computerized control system.

* * * * *